United States Patent [19]

Wengert et al.

[11] 4,243,695

[45] Jan. 6, 1981

[54] DOUBLE MASK RASTER METHOD FOR APPLYING SLURRY IN A DISCRETE PATTERN

[75] Inventors: Rolf Wengert, Munich; Wilhelm Huber, Goldach, both of Fed. Rep. of Germany

[73] Assignee: Siemens Aktiengesellschaft, Berlin & Munich, Fed. Rep. of Germany

[21] Appl. No.: 7,837

[22] Filed: Jan. 30, 1979

[30] Foreign Application Priority Data

Jan. 31, 1978 [DE] Fed. Rep. of Germany ..... 2804127

[51] Int. Cl.[3] ..... H01J 9/227

[52] U.S. Cl. ..... 427/14.1; 427/88

[58] Field of Search ..... 427/14.1, 68

[56] References Cited

U.S. PATENT DOCUMENTS 3,484,269 12/1969 Jonkers et al. ..... 427/68 X
3,593,678 7/1971 Miller ..... 118/630

FOREIGN PATENT DOCUMENTS 1139875 11/1962 Fed. Rep. of Germany .
1537483 10/1969 Fed. Rep. of Germany .
1447791 8/1972 Fed. Rep. of Germany .
1462853 10/1972 Fed. Rep. of Germany .
2219261 11/1973 Fed. Rep. of Germany .

OTHER PUBLICATIONS

Valvo Reports, vol. XVIII, issue 1/2, "Method in the Production Process", pp. 80–81.

*Primary Examiner*—James R. Hoffman
*Attorney, Agent, or Firm*—Hill, Van Santen, Steadman, Chiara & Simpson

[57] ABSTRACT

A double mask raster method for application of a number of different slurries in a discrete pattern, to produce a raster such as can be used in color television picture tubes, has a first mask having a plurality of apertures therein which remains immovably on the substrate throughout the application of all slurries. A separate second mask having a smaller number of aligned apertures therein is utilized with each successive application of a different slurry, allowing the slurry to penetrate the two masks to the substrate only where apertures in the two masks are aligned. The method may be used to apply slurries to flat or curved substrates in a vertical or horizontal position adapted for conventional spraying, or by means of electrostatic spraying.

13 Claims, 9 Drawing Figures

DOUBLE MASK RASTER METHOD FOR APPLYING SLURRY IN A DISCRETE PATTERN

BACKGROUND OF THE INVENTION

1. Field of the Invention

This invention relates to methods for applying slurry or the like to a substrate in a discrete pattern, and particularly to a method for application of a phosphorescent slurry to a glass substrate for use as a color television raster.

2. Description of the Prior Art

The production of a color raster for a color television picture tube requires the application of primary phosphors or fluorescent substances such as red, green and blue to a substrate which is the inside portion of the screen area of a color picture tube. The method presently practiced in the art requires a sequence of repeated steps associated with the application of each phosphor, which is time-consuming and does not allow the reclamation of unused phosphor slurry for subsequent reuse in the method.

The currently practiced method involves coating the total surface of the substrate with a slurry of a first phosphor to be applied. The phosphor layer contains photosensitive material, such as photo-resist. Light is shown through a mask and the photosensitive phosphor layer is removed where not struck by the light, leaving a pattern of dots or stripes of the first phosphor to be applied. This process is repeated two more times in the case of color picture tubes in order to deposit a raster of primary color phosphors such as red, green and blue on the glass substrate.

The above method is known from German Pat. No. 1,447,791 and from German Auslegeschrift No. 1,462,653.

The above method possesses several disadvantages. Because of the repeated superimposed coating of the different phosphorescent slurries on the substrate, purity of the individual of the discrete slurry deposits on the substrate is diluted, and mixing of the slurries occurs to some degree, thereby resulting in inaccurate reproduction during use. Color impurities may be formed on the substrate glass directly, if residues remain after the rinsing of the non-exposed coated areas, as the rinsing pressure must not be too great so that the remaining fluorescent slurry deposits are not removed also.

SUMMARY OF THE INVENTION

The present invention provides a double mask raster method for applying slurry in a discrete pattern which eliminates the numerous and cumbersome steps of phototechnique and provides discrete areas of fluorescent deposits on the substrate which result in extremely accurate color reproduction when used to form a color raster in a color television picture tube.

The method provides for a first mask having apertures corresponding to the placement of all phosphors to be deposited which remains on the substrate throught the entire depositing process. A second mask having a number of apertures approximately equal to a fraction of the apertures in the first mask equal to the reciprocal of the number of phosphors to be applied is placed over the first mask during the application of each phosphor slurry. A different second mask associated with each phosphor to be applied has apertures therein in different positions than masks associated with the other phosphors, but which are in alignment with a portion of the apertures in the first mask.

During the application of a particular color sensitive phosphor, the second mask associated therewith allows phosphor to be deposited on the substrate only in those areas beneath apertures in the first and second masks which are in alignment with each other. All other apertures in the first mask are blocked by solid portions of the second mask. After the phosphor is deposited, such as by spraying, on the substrate, the unused, undeposited phosphor may be rinsed away and reclaimed for later use, as the slurry will not be contaminated by other phosphors because no opportunity for the mixing of slurries occurs with this method.

The application is repeated for each different color sensitive phosphor to be deposited, utilizing a different second mask for each phosphor.

DESCRIPTION OF THE PREFERRED EMBODIMENTS

FIGS. 1*a* through 1*e* show in cross-section a substrate with a mask thereon, with an additional mask corresponding to each application of a different phosphor slurry.

Figure 1A:
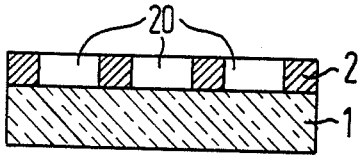
FIG. 1*a* shows a cross-sectional view of a substrate with a base mask thereon.

FIG. 1*a* shows a substrate 1 with a base mask 2 having a plurality of apertures 20 therein. The base mask 2 may be made of magnetic steel plate provided with a magnetic nickel coating, or of steel plate provided with copper coating, or may be galvanoplastically produced of nickel. The base mask 2 is held immovably in place on the substrate 1 by means of surface magnets not shown. The apertures 20 in the base mask 2 determine the size, sharpness, separation and spacing of the phosphor deposits on the substrate 1. The apertures 20 in the base mask 2 are at least of the size of 0.01 $mm^2$. The thickness of the base mask 2 is approximately 10 to 30 μm larger than the planned thickness of the fluorescent deposits.

Figure 1B:
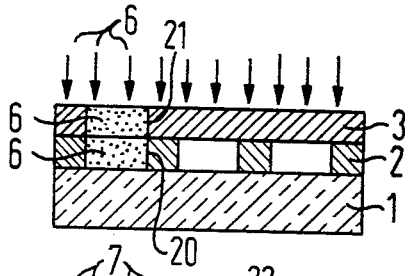
FIG. 1*b* shows a cross-sectional view of a substrate with a base mask and a second mask associated with a first phosphor thereon.

FIG. 1*b* shows a second mask 3 having a plurality of apertures 21 therein for admission of a first color sensitive phosphor 6. The phosphor 6 is applied in the direction of the arrows shown by suitable means, and only those apertures 20 in the base mask 2 which are aligned with the apertures 21 in the second mask 3 will admit the phosphor 6 to be deposited on the substrate 1. The other apertures in the base mask 2 remain covered by the second mask 3. The number of apertures 21 in the second mask 3 is a fraction of the apertures 20 in the base mask 2 equal to the reciprocal of the number of phosphors to be deposited. For example, if three phosphors, corresponding to the primary colors, are to be deposited on the substrate 1, the second mask 3 will have $\frac{1}{3}$ of the number of apertures as the base mask 2. In general, if n number of phosphors are to be deposited, the second masks associated with each phosphor will have 1/n the number of apertures as the base mask.

Figure 1C:
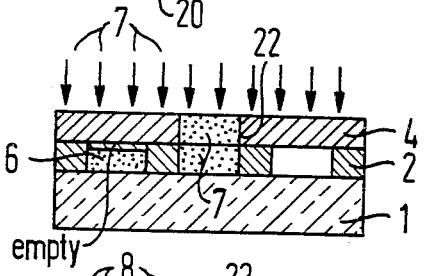
FIG. 1*c* shows a cross-sectional view of a substrate with a base mask and a second mask associated with a second phosphor thereon.

FIG. 1*c* shows a second mask 4 associated with a second phosphor 7 which has apertures 22 aligned with apertures 20 in the base mask 2 to admit phosphor 7 in selected areas.

Figure 1D:
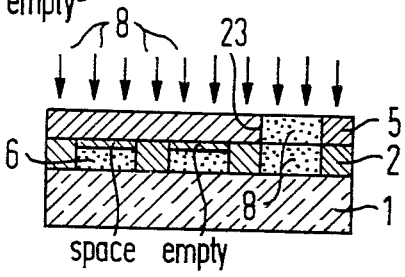
FIG. 1*d* shows a cross-sectional view of a substrate with a base mask and a second mask associated with a third phosphor thereon.

FIG. 1*d* similarly shows a second mask 5 associated with a third phosphor 8 which has apertures 23 therein aligned with apertures 20 in the base mask 2 to admit the phosphor 8 to the substrate 1.

Figure 1E:
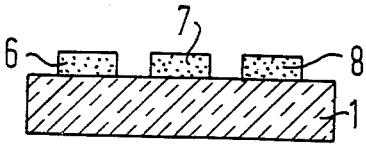
FIG. 1*e* shows a cross-sectional view of a substrate with discrete phosphor deposits thereon.

FIG. 1*e* shows the completed color raster, which is comprised of the substrate 1 with discrete deposits of the three phosphors such as 6, 7 and 8. The areas between the discrete deposits of phosphors are free from contaminants, having remained covered by the base mask 2 throughout the entire application process.

After each individual phosphor has been sprayed onto the substrate 1, the excess, unused phosphor slurry remaining on top of the second mask, such as the mask 3 used in association with phosphor 6, may be rinsed away and reclaimed for subsequent use. The rinsing can be much more effective than that used with the phototechnique method, because the masks 2 and 3 will retain the phosphor deposit 6 in place, without fear of the pressure of the rinsing solvent washing away part of the deposit. There is also no danger of contamination of the unused phosphor slurry, because no opportunity for mixing of two slurries is present, because subsequent slurries are applied with the protective covering of an associated second mask.

It will be understood that the steps associated with the application of a deposit of each phosphor may be repeated as many times as there are phosphors, and need not be limited to the three depositing procedures described herein.

Figure 2:
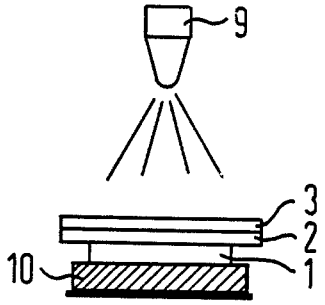
FIG. 2 shows an arrangement for spraying phosphor slurry on a horizontally disposed flat substrate.

FIG. 2 shows an apparatus for spraying phosphor slurry onto a flat horizontally disposed substrate. The substrate 1 is held in place by a flat holding magnet 10 disposed beneath the substrate 1, and has the base mask 2 and a second mask 3 thereon. It will be understood that second mask 4 and 5 may also be utilized in this configuration. A spraying means 9 is disposed above the substrate and has spray jets therein suitably sized to prevent the depositing of larger particles on the substrate 1.

Figure 3:
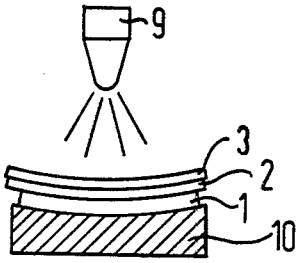
FIG. 3 shows an apparatus for spraying phosphor slurry on a horizontally disposed curved substrate.

FIG. 3 shows a similar configuration for spraying phosphor slurry onto a curved substrate. The holding magnet 10 has a curved upper surface for retaining the curved substrate 1, and the base mask 2 is also suitably curved to lie adjacent the substrate 1. A curved second mask 3 is adjacent the base mask 2, and it will be understood that second masks 4 and 5 can be substituted therefore during appropriate times in the method.

The arrangement shown in FIGS. 2 and 3 is suitable for use with relatively slow drying fluorescent slurries, for example slurries containing water. Because the substrate is horizontally disposed, there is no danger that the slurry will run due to the action of gravity during drying.

Figure 4:
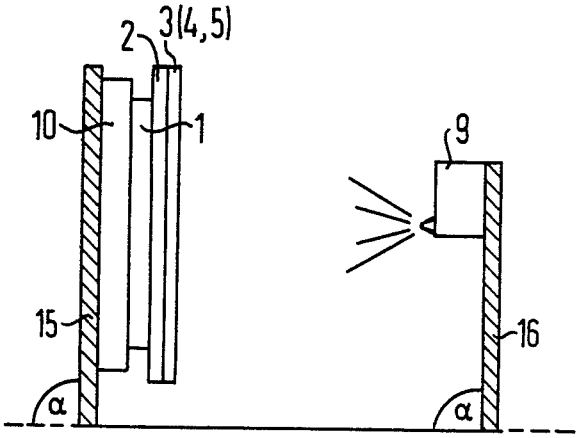
FIG. 4 shows an apparatus for spraying phosphor slurry on a vertically disposed substrate.

FIG. 4 shows an arrangement which may be utilized with relatively fast drying slurries, such as water-free slurries. The substrate 1 is again held in place by a holding magnet 10, which is maintained in a vertical position by a suitable means 15. The substrate 1 has a base mask 2 and a second mask 3 thereon, and it will be understood that second masks 4 and 5 may be substituted therefore at appropriate times during the procedure. A sprayer means 9 is disposed on a supporting means 16 to direct a horizontal spray toward the substrate 1. Because the slurry utilized with the arrangement of FIG. 4 is relatively fast drying, the slurry will not run downwards due to the action of gravity during a drying period. The apparatus of FIG. 4 may also be utilized with electrostatic spraying means.

Figure 5:
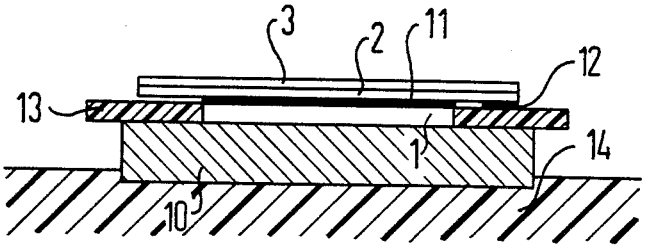
FIG. 5 shows an arrangement for electrostatic application of phosphor slurry to a substrate.

The substrate arrangement for electrostatic spraying is schematically shown in FIG. 5. The substrate 1 is provided with a positive contact 12 at a conductive layer 11, which is composed of any suitable material such as tin oxide. The base mask 2 is disposed on top of the substrate 1, as is the second mask 3. It will be understood that second masks 4 and 5 may be substituted for second mask 3 at appropriate times during the procedure. The substrate 1 and the electrical conducting material 11 are insulatedly supported by insulating material 13. The holding magnet 10 is also electrically insulated at its exterior by insulator 14. The spraying jets (not shown) are grounded, representing the negative pole. Negatively charged slurry particles emitted from the sprayer means are thus attracted to the positively charged substrate 1, thereby insuring effective depositing of the phosphor thereon. The entire means consisting of the insulator 14 holding the magnet 10 and the substrate 1, and the spraying means may be electrically insulated by means such as a plexiglass bell. The method of the present invention may be used with a number of fluorescent pigment color substances known in the art, but is not necessarily limited to use therewith. The grain distribution of the slurry liquids is preferably between 1 and 3 μm minimum to 10 to 15 μm maximum. The viscosity of the emulsions is preferably controlled via the addition of binders, preferably in the form of nitrated cellulose in the range of 1 to 35% by volume. Fluorescent substances generally utilized in the art are zinc sulphide doped with silver for blue, zinc cadmium sulphide, doped with copper for green, and yttrium sulphoxide doped with europium for red. In addition, other known phosphors can be utilized, for example ytrrium vanadate doped with europium, ytrrium oxide doped with europium, and calcium silicate doped with manganese for red; zinc sulphide doped with copper, zinc cadmium sulphide doped with silver, zinc silicate doped with manganese, zinc oxide, gadolinium sulphoxide doped with terbium, and lanthanum sulphoxide doped with terbium for green; and calcium tungstate and barium-magnesium-aluminate doped with europium for blue.

A suitable waterless fluorescent slurry solution approximately contains, but is not limited to:

| | |
|---|---|
| Fluorescent portion | 10 through 35% by wt. |
| Butylacetate | 10 through 20% by vol. |
| Ethanol | 1 through 20% by vol. |
| Xylene | 0 through 10% by vol. |
| Highly volatile acetates with methanol and butanol such as methyl alcohol and | |

-continued

| | |
|---|---|
| butyl alcohol | 10 through 30% by vol. |
| Other low alcohols | 0 through 20% by vol. |
| Binder: nitrated cellulose in buty acetate and ethanol (for example, 1:1:1) | 1 through 35% by vol. |
| Special adhesive agents such as silicon ester | 0 through 10% by vol. |

Such a waterless slurry has the advantage of providing a fine distribution of the fluorescent microcrystals without lumping and also the advantage of quite rapid drying. Such a slurry solution can be used in all spray techniques.

A water-containing fluorescent slurry may consist of, but is not necessarily limited:

| | |
|---|---|
| Fluorescent share | 10 through 35% by wt. |
| Deionized water | 20 through 35% by vol. |
| Polyvinyl alcohols as binders | 20 through 60% by vol. |
| Antifoaming agents | 0.05 through 1% by vol. |

The water-containing fluorescent slurries are characterized by a slow drying time, and are most advantageously used in electrostatic spraying and spraying onto hot substrates.

Following the coating process, it is generally preferable to undertake a tempering in an oxygen containing atmosphere in order to expel organic compounds and, if necessary, to stabilize the adhesive agents. It is generally preferable, though not necessarily limited thereto, to conduct the tempering process in oxygen for at least 30 minutes at a temperature of 250° to 400° C. The tempering step can also be undertaken in the presence of pressure slightly below atmospheric pressure. The method of the present invention allows the share of binders to be held lower than in the phototechnique method which requires that sufficient binder be present to maintain the deposits in place during a relatively high pressure rinsing step. Greater adhesive strength by spraying results in improved optical contact of the fluorescent deposit relative to the substrate which forms one side of the television screen.

Although various modifications may be suggested by those versed in the art, applicants wish to embody in the patent warranted hereon all such changes and modifications which reasonably come within the scope of applicants contribution to the art.

We claim:

1. A method for applying a plurality of different slurries to a glass television picture screen comprising the steps of:

maintaining a base mask having a plurality of apertures immovably in position adjacent the glass screen;

placing a second mask associated with a slurry to be applied over said base mask, said second mask having a plurality of apertures which is less than the plurality of apertures in said base mask;

aligning the apertures in said second mask with apertures in said base mask;

applying a slurry evenly over said second mask;

rinsing away excess slurry;

removing said second mask;

repeating said method with a second mask associated with each slurry to be applied, each said second mask having apertures therein which do not overlap apertures in masks associated with other slurries.

2. The method of claim 1 wherein the number of apertures in each second mask associated with each slurry is a fraction of the number of apertures in said base mask equal to the reciprocal of the number of slurries to be applied.

3. The method of claim 1 wherein the step of applying a slurry evenly over said second mask consists of spraying said slurry onto said second mask.

4. The method of claim 1 wherein the step of applying a slurry evenly over said second mask comprises the steps of:

providing a means for positively charging said glass screen;

grounding a means of spraying said slurry over said second mask;

spraying said slurry over said second mask.

5. The method of claim 4 wherein a potential in the range of 20 to 30 kV exists between said glass screen and said grounded spraying means.

6. A method for applying three different slurries to a glass television picture screen, each slurry containing a fluorescent substance in the range of 10% to 35% by weight, butylacetate in the range of 10% through 20% by volume, ethanol in the range of 1% through 20% by volume, xylene in the range of 0% through 30% by volume, volatile acetates with methanol and butanol in the range of 10% through 30% by volume, and other low alcohols in the range of 0% through 20% by volume, said method comprising:

maintaining a base mask having a plurality of apertures immovably in position adjacent the glass screen;

taking a first slurry with a fluorescent substance which is a red emitting phosphor;

placing a second mask associated with said first slurry over said base mask, said second mask having a plurality of apertures which is less than the plurality of apertures in said base mask;

aligning the apertures in said second mask with apertures in said base masks;

applying said slurry evenly over said second mask;

removing said second mask;

repeating said method substituting for said first slurry which is a blue emitting phosphor, and substituting a third mask associated with said second slurry for said second mask, said third mask having a plurality of apertures therein in non-alignment with said apertures in said second mask;

repeating said method substituting for said first slurry a third slurry with a fluorescent substance which is a green emitting phosphor and substituting a fourth mask associated with said third slurry for said second mask, said fourth mask having a plurality of apertures therein in non-alignment with said apertures in said second and third masks.

7. A method for applying three different slurries to a glass television picture screen, each slurry containing a fluorescent substance in the range of 10% through 35% by weight, deionized water in the range of 20% through 35% by volume, polyvinyl alcohols in the range of 20% through 60% by volume, and anti-foaming agents in the range of 0.05% through 1% by volume, said method comprising:

maintaining a base mask having a plurality of apertures immovably in position adjacent the glass screen;

taking a first slurry with a fluorescent substance which is a red emitting phosphor;

placing a second mask associated with said first slurry over said base mask, said second mask having a plurality of apertures which is less than the plurality of apertures in said base mask;

aligning the apertures in said second mask with apertures in said base mask;

applying said slurry evenly over said second mask;

rinsing away excess slurry;

removing said second mask;

repeating said method substituting for said first slurry a second slurry with a fluorescent substance which is a blue emitting phosphor, and substituting a third mask associated with said second slurry for said second mask, said third mask having a plurality of apertures therein in non-alignment with said apertures in said second mask;

repeating said method substituting for said first slurry a third slurry with a fluorescent substance which is a green emitting phosphor, and substituting a fourth mask associated with said third slurry for said second mask, said fourth mask having a plurality of apertures therein in non-alignment with said apertures in said second and third masks.

8. The method of claim 6 further including the step of choosing the fluorescent substance for said first slurry from a group consisting of yttrium venadate doped with europium, yttrium oxide doped with europium, yttrium sulphoxide doped with europium, and calcium silicate doped with manganese.

9. The method of claim 6 further including the step of choosing the fluorescent substance for said second slurry from a group consisting of zinc sulphide doped with silver, calcium tungstate, and barium-magnesium-aluminate doped with europium.

10. The method of claim 6 further including the step of choosing the fluorescent substance for said third slurry from a group consisting of zinc cadmium sulphide doped with zinc copper, zinc sulphide doped with silver, zinc cadmium doped with silver, zinc silicate doped with manganese, zinc oxide, and gadolinium sulphoxide doped with terbium, and lanthanum sulphoxide doped with terbium.

11. The method of claim 7 further including the step of choosing the fluorescent substance for said first slurry from a group consisting of yttrium venadate doped with europium, yttrium oxide doped with europium, yttrium sulphoxide doped with europium, and calcium silicate doped with manganese.

12. The method of claim 7 further including the step of choosing the fluorescent substance for said second slurry from a group consisting of zinc sulphide doped with silver, calcium tungstate, and barium-magnesium-aluminate doped with europium.

13. The method of claim 7 further including the step of choosing the fluorescent substance for said third slurry from a group consisting of zinc cadmium sulphide doped with copper, zinc sulphide doped with silver, zinc cadmium sulphide doped with silver, zinc silicate doped with manganese, zinc oxide, and gadolinium sulphoxide doped with terbium, and lanthanum sulphoxide doped with terbium.

* * * * *